United States Patent [19]

Argudo et al.

[11] Patent Number: 5,042,680

[45] Date of Patent: Aug. 27, 1991

[54] RECLOSABLE CONTAINER ASSEMBLY

[75] Inventors: Marcos A. Argudo, Chino; Frank C. DeVore, Orange; Robert L. Combe, Altaloma, all of Calif.

[73] Assignee: Tri-Plas, Inc., Ontario, Calif.

[21] Appl. No.: 562,256

[22] Filed: Aug. 3, 1990

[51] Int. Cl.[5] ..... B65D 17/40

[52] U.S. Cl. ..... 220/276; 220/270

[58] Field of Search ..... 220/276, 257, 270, 306, 220/657, 659, 643, 644

[56] References Cited

U.S. PATENT DOCUMENTS

| | | | |
|---|---|---|---|
| 2,998,158 | 12/1954 | Tupper . | |
| 3,438,533 | 4/1969 | Hanisch et al. | 220/257 |
| 3,557,998 | 1/1971 | Collie . | |
| 4,037,748 | 7/1977 | Stubbs, Jr. . | |
| 4,190,175 | 2/1980 | Allen | 220/270 |
| 4,422,559 | 12/1983 | Landis | 220/306 |
| 4,493,432 | 1/1985 | Smith | 220/270 |
| 4,610,351 | 9/1986 | Coles et al. | 220/659 X |
| 4,682,706 | 7/1987 | DeVore et al. . | |
| 4,711,364 | 12/1987 | Letica | 220/276 |
| 4,790,448 | 12/1988 | Ostrum et al. | 220/270 |
| 4,819,825 | 4/1989 | Landis | 220/276 |
| 4,865,216 | 9/1989 | Landis | 220/270 |
| 4,930,656 | 6/1990 | Blanchette | 220/276 |
| 4,961,512 | 10/1990 | Von Holdt | 220/270 |

*Primary Examiner*—Stephen P. Garbe
*Assistant Examiner*—Vanessa M. Roberts
*Attorney, Agent, or Firm*—Sixbey, Friedman, Leedom & Ferguson

[57] ABSTRACT

A reclosable container assembly includes a container having a container sidewall extending to an open end with a laterally extending flange formed at said open end and extending outwardly from said container sidewall. A container locking lip extends from said laterally extending flange away from said open end in spaced relation to said sidewall, and the locking lip includes an outer seating surface which extends from the laterally extending flange and angles inwardly toward the container sidewall. A plurality of spaced support ribs extend between the container sidewall and the locking lip, and a closure member is provided having a skirt which engages the locking lip to attach the closure member to the container. The closure member includes a top wall with the skirt extending outwardly from the periphery of the top wall. The top wall and skirt are formed such that the closure member does not contact the sidewall of the container when the closure member is attached to the container, and the skirt has an inner surface which engages the outer seating surface of said locking lip and which extends from the top wall and angles inwardly therefrom.

20 Claims, 1 Drawing Sheet

RECLOSABLE CONTAINER ASSEMBLY

TECHNICAL FIELD

The present invention relates, in general, to reclosable container and cap assemblies, and more particularly, to a novel combination for enhancing the engagement between a container and a container cap having a locking tear strip once the tear strip has been removed.

BACKGROUND ART

In the past, numerous attempts have been made to design plastic containers for food and other consumable products which include a plastic closure cap for the container having a tear strip which must be removed the first time the container is opened, thereby providing security against adulteration or contamination of the product. Generally, such container closure caps are designed for reuse, so that once the tear strip is removed, the cap still operates effectively to reclose the container.

A very effective reclosable container with a tamper indicator is illustrated by U.S. Pat. No. 4,682,706 to F. DeVore et al., which is assigned to the assignee of the present application. Here, the tear off strip for the container closure has a plurality of spaced apart grooves defined in the surface thereof which are covered by a web so that the tear off strip outer member appears smooth. The web over each groove is adapted to break when a relatively small force is applied at any location along the tear off strip between the grooves to indicate that the assembly has been tampered with. Once the tear off strip is removed, the closure member is reusable and is retained on the container by a central section which is inserted into the container and engages the container inner wall combined with a small portion of the closure which remains to engage the container outer wall.

In reclosable containers having tear strips, this use of a cap configuration wherein a portion of the cap extends into the container to engage the inner wall of the container and cooperate with an outer portion of the cap remaining after the removal of a tear strip is quite common, as illustrated by U.S. Pat. Nos. 2,998,158 to E. S. Tupper, U.S. Pat. No. 3,356,250 to N. E. Russell, U.S. Pat. No. 3,557,998 to S. D. Collie, and U.S. Pat. No. 4,660,735 to P. Peschardt et al. All of these patents illustrate such reclosable cap structures wherein, once a tear strip is removed, the cap may be remounted on a container and held in place by engagement between portions of the cap and the inner and outer wall of the container.

For some plastic and paperboard containers, it is not desirable to provide a container closure cap having a portion of the cap which extends downwardly in engagement with the inner wall of the container. This, for example, might be true of ice cream containers where the container lid or cap is positioned above a membrane sealed to the upper lip of the container and extending across the container contents. It is extremely desirable to close such containers with a tamper indicating cap having a tear strip, and it is also desirable to be able to tightly reclose these containers once the tear strip has been removed. However, this reclosure cannot be accomplished by engagement between the cap and both the inner and outer surfaces of the container.

DISCLOSURE OF THE INVENTION

It is a primary object of the present invention to provide a novel and improved reclosable container assembly designed to initially permit a container closure or lid to be locked to the container in such a manner that opening of the lid must be accompanied by the removal of a tear strip. However, the lid may be tightly resealed to the container due to a novel reclosure structure for both the lid and the container wherein the container includes support ribs to resist deflection of a container locking lip.

Another object of the present invention is to provide a novel and improved reclosable container assembly including a tamper indicator which automatically directs forces created by attempted or actual tampering to rupture locations on the tamper indicator.

A further object of the present invention is to provide a novel and improved reclosable container assembly having a closure lid or cap which does not engage the inner wall of the container during use. The lid is provided with both a locking tear strip and a tamper indicator which provides apparent and nonconcealable evidence of an attempted or actual entry into the container at any location on the periphery of the container closure.

A still further object of the present invention is to provide a novel and improved reclosable container assembly with a closure cap having an external tear strip to lock the cap to the container. Once the tear strip is removed, the closure cap or lid may be retained on the container through engagement of the cap with only an outer surface of the container, the container being formed with novel support ribs to bias the outer surface into engagement with the container cap. This support rib biasing structure additionally provides force against an outer skirt of the cap so that a web over tamper indicating grooves is adapted to break when a relatively small force is applied at any location along a tear off strip for the cap.

These and other objects of the present invention are accomplished by providing a reclosable container having a container sidewall extending to an open end of the container with a laterally extending flange formed at the open end and extending outwardly from the container sidewall. A container locking lip extends from the laterally extending flange away from the open end in spaced relation to the sidewall, and the locking lip includes an outer seating surface which extends from the laterally extending flange and angles inwardly toward the container sidewall. A plurality of spaced support ribs extend between the container sidewall and the locking lip, and a closure member is provided having a skirt which engages the locking lip to attach the closure member to the container. The closure member includes a top wall with the skirt extending outwardly from the periphery of the top wall. The top wall and the skirt are formed such that the closure member does not contact the sidewall of the container. When the closure member is attached to the container, the skirt has an inner surface which engages the outer seating surface of the locking lip and which extends from the container top wall and angles inwardly therefrom. The skirt includes a locking groove positioned below the angled inner surface thereof to secure the closure member to the locking lip, and a tear strip extends below the locking groove. The tear strip includes a plurality of spaced apart grooves formed therein and extending into the tear strip to a thin membrane which extends across and bridges each such groove.

DETAILED DESCRIPTION OF THE DRAWINGS

BEST MODE FOR CARRYING OUT THE INVENTION

Figure 1:
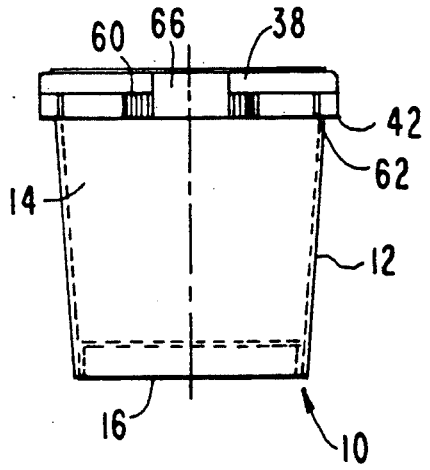
FIG. 1 is a view in side elevation of the reclosable container assembly of the present invention.

Referring now to the drawings, the reclosable container assembly of the present invention indicated generally at 10 includes a container 12 having a sidewall 14 which extends upwardly from a bottom wall 16. The side wall extends to an open end 18 of the container where it meets an annularly, laterally extending flange 20 that supports a locking lip 22. This locking lip includes a first section 24 extending downwardly from the flange 20 toward the bottom wall 16 of the container in spaced relationship to the sidewall 14, and at a lower extremity 26 of this first section, the locking lip is provided with a second section 28 which extends obliquely to a terminal end 30. It is important to note that the first section 24 of the locking lip 22 includes an outer surface 32 which angles inwardly from the laterally extending flange 20 to the lower extremity 26 and provides a locking surface for the locking lip. To form this inwardly angled outer surface, it will be noted that the first section of the locking lip decreases in thickness from the laterally extending flange 20 to the lower extremity 26, so that the thickest portion of this first section is adjacent to the laterally extending flange 20 as indicated at 34. A plurality of support ribs 36 extend between the sidewall 14 of the container and the first section of the locking lip 22, and it will be noted that these support ribs fill the space between the first section of the locking lip and the container side wall from the laterally extending flange to the lower extremity 26 of the first locking lip section.

Figure 3:
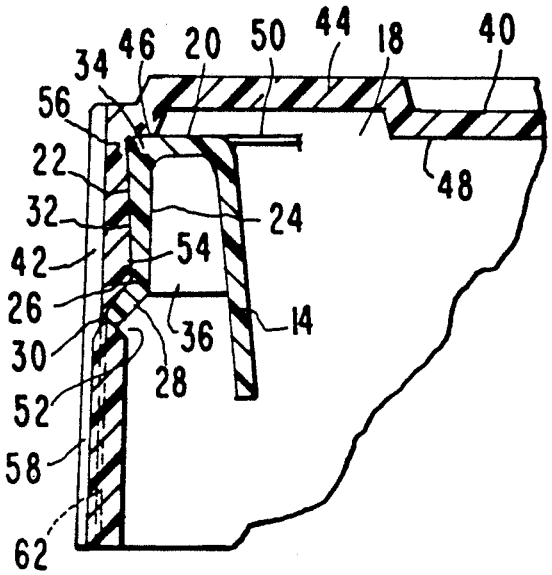
FIG. 3 is a sectional view of a portion of the reclosable container of FIG. 1.

The container 12 is formed to cooperate with a closure member 38 to complete the reclosable container assembly 10 of the present invention. This closure member includes a top wall 40 having a skirt 42 extending outwardly from the periphery thereof. As shown in FIG. 3, the top wall of the closure member may include a raised, flat peripheral portion 44 where instructions, labels, or other informative material may be placed. It will be noted that at the juncture of the top wall 40 with the skirt 42, the top wall of the closure member 38 is provided with an internal ledge 46 which extends circumferentially around the inner surface of the top wall and which engages the laterally extending flange 20 of the container 12 when the closure member is in place on the container. The surface of the ledge 46 is preferably aligned in the plane of a bottom surface 48 for the closure member 38, this bottom surface extending across the closure with the exception of the area beneath the raised peripheral portion 44 thereof. Since the closure member 38 does not engage the sidewall 14 of the container 12 at any point when the closure member is locked in place on the container, a layer of film, paper, or other sheet material 50 can be sealed across the open end 18 of the container and engaged by the flange 46 and lower surface 48 of the closure member top wall. The ability to include the sheet material 50 can prove important when the container 12 is filled with ice cream or similar material which should be sealed within the container.

The skirt 42 of the closure member 38 includes, on the inner surface thereof, a circumferentially extending notch or locking groove 52 which receives the terminal end of the second section- 28 for the locking lip 22, and which, in fact, receives and engages the entire upper surface of this second section. Between the top wall 40 and the groove 52, the skirt 42 includes an inner surface 54 which is adapted to tightly engage the outer surface 32 of the first section of the locking lip 22 when the closure member is in place on the container. The surface 54 is angled inwardly from the ledge 46 to the groove 52, and it will be noted that the skirt 42, to provide this inclined surface, increases in thickness from a point 56 of minimum thickness adjacent the top wall 40 to a point of maximum thickness at the groove 52.

Figure 5:
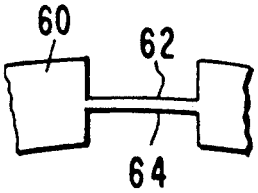
FIG. 5 is a sectional view of a portion of the tear strip for the reclosable container assembly of FIG. 1.

The lower portion of the skirt 42 forms a tear off strip 58 which is connected to the remainder of the skirt by a tear line 60 extending peripherally around the exterior of the skirt in the area of the groove 52. The tear line 60 and groove 52 form a hinge beneath the tear line in the manner described by U.S. Pat. No. 4,682,706, the disclosure of which is incorporated herein by reference. The tear off strip 58 is formed in the manner described in the aforementioned patent and includes a plurality of spaced grooves 62 which are located at a plurality of positions about the circumference of the tear off strip. These grooves extend to a membrane which bridges the grooves and imparts a smooth outer surface to the tear strip as indicated in FIG. 2, or the grooves may extend into the tear off strip to a central membrane 64 as illustrated in FIGS. 1 and 5.

When the closure member 38 is locked in place on the container 12, any attempt to pry up the tear off strip 58, or to insert an object under the tear off strip will cause the strip to snap upwardly about the hinge formed by the tear line 60 and the groove 52 to break the membrane 64 bridging the groove 62. This provides an effective tamper indicator for the reclosable container assembly.

Preferably, the closure member 38 and the reclosable container 12 are formed of plastic or similar material having some flexibility. After the reclosable container 12 is filled with material and, in some instances, sealed by the film 50, the closure member 38 is engaged over the open mouth of the container. Initially, the tear off strip 58 passes over the locking lip 22 and is deformed outwardly by the locking lip. It will be noted that this outward deformation is enhanced by having the thinnest portion of the skirt 42 adjacent the top wall 40 of the closure member so that the skirt flexes outwardly at this point while at the same time having the thickest and most rigid portion 34 of the locking lip as the first portion of the locking lip engaged by the skirt. The skirt is not permanently deformed and will yield elastically owing to the resiliency of the plastic material forming the skirt, and once the terminal end 30 and the second section 28 of the locking lip snap into the locking groove 52, the inclined surface 32 of the skirt is held in tight engagement with the surface 54 of the locking lip and, with the closure member locked in place on the container, circumferentially directed tension is applied by the locking lip to the skirt 42 and particularly to the tear off strip 58.

Figure 2:
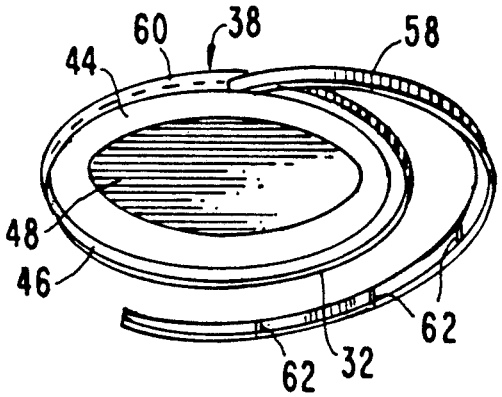
FIG. 2 is a perspective view showing a closure member for the reclosable container assembly of FIG. 1 having a tear off strip which is partially torn away.
Figure 4:
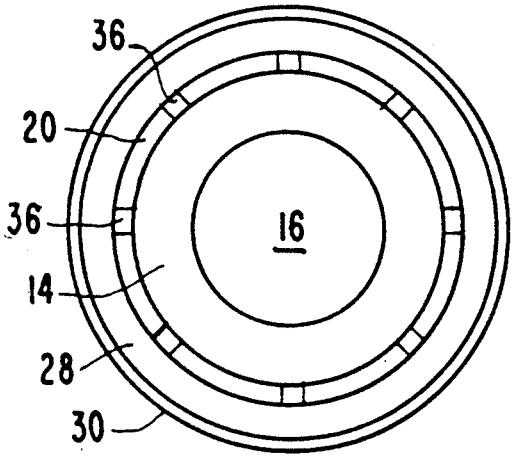
FIG. 4 is a bottom plan view of the container for the reclosable container assembly of FIG. 1.

To remove the closure member 38 from the container 12, a tab 66 is lifted and the tear off strip is removed as illustrated in FIG. 2. Now, the bottom portion of the locking groove 52 has been removed, and the closure 38 can be lifted upwardly from the container 12. To re-seat the closure, the thickened lower portion of the first section of the closure skirt is forced over the thickened portion 34 of the locking lip causing the skirt to flex outwardly about its thinnest portion 56 and snap onto the locking lip. The inclined surfaces 32 of the locking lip and 54 of the closure skirt provide seal and lock between the two, for the ribs 36 ensure that the locking lip is forced into tight engagement with the closure skirt which is maintained as long as the closure member is in place on the container.

INDUSTRIAL APPLICABILITY

The reclosable container assembly of the present invention is both effective in providing an indication of tampering before a closure member is unlocked from the container, and also, once the closure is unlocked, ensures that the closure may be relocked and sealed to the container without the necessity of engagement between the closure and the container side wall.

What is claimed:

1. A reclosable container assembly comprising a container having a bottom wall, a container sidewall extending from said bottom wall to an upper end remote from said bottom wall, a laterally extending flange formed at said upper end and extending outwardly from said sidewall, a container locking lip extending from said laterally extending flange toward said bottom wall in spaced relation to said sidewall, and a plurality of spaced support rib means extending between said sidewall and said locking lip, and a closure member having a skirt means thereon which engages the locking lip to attach the closure member to the container.

2. The reclosable container assembly of claim 1 wherein said locking lip includes a first section which extends from said laterally extending flange to a first section lower extremity spaced from said laterally extending flange and a second section which extends obliquely outwardly from said first section lower extremity away from said sidewall to a terminal end.

3. The reclosable container assembly of claim 1 wherein said locking lip includes an outer surface which angles inwardly from said laterally extending flange toward said sidewall.

4. The reclosable container assembly of claim 2 wherein said first section includes an outer surface which angles inwardly from said laterally extending flange to said first section lower extremity.

5. The reclosable container of claim 4 wherein said first section is of maximum thickness adjacent to said laterally extending flange and decreases in thickness from said laterally extending flange to said first section lower extremity.

6. The reclosable container assembly of claim 5 wherein each of said spaced support rib means extends between said sidewall and the first and second sections of said locking lip.

7. The reclosable container assembly of claim 6 wherein each of said spaced support rib means contacts said locking lip from the terminal end thereof to the laterally extending flange and extends from said sidewall across the space between said sidewall and the locking lip from said laterally extending flange to the terminal end of said locking lip.

8. The reclosable container assembly of claim 1 wherein said closure member includes a tear-off strip means attached to the skirt for locking the closure member to the locking lip, said tear off strip means including a plurality of spaced apart grooves formed therein and extending around the extent thereof, said grooves extending into said tear-off strip to a thin membrane which extends across and bridges each said groove.

9. The reclosable container assembly of claim 2 wherein said closure member includes a top wall, said skirt means extending outwardly from the periphery of said top wall to engage and extend beyond the first and second sections of said locking lip when said closure member is attached to said container.

10. The reclosable container assembly of claim 9 wherein said first and second sections of said locking lip include outer surfaces and said closure member skirt means includes an inner surface which engages the outer surfaces of said first and second sections when said closure member is attached to said container, the inner surface of said skirt means including a locking groove for receiving the terminal end of the second section of said locking lip.

11. The reclosable container assembly of claim 10 wherein the top wall and skirt means of said closure member are formed such that said closure member does not contact the sidewall of said container when the closure member is attached to said container.

12. The reclosable container assembly of claim 11 wherein the inner surface of said closure member skirt means which engages the outer surface of the first section of said locking lip when said closure member is attached to said container is angled inwardly between said top wall and said locking groove.

13. The reclosable container assembly of claim 12 wherein the skirt means for said closure member increases in thickness from said top wall to said locking groove.

14. The reclosable container assembly of claim 13 wherein said closure member skirt means includes a circumferential tear line adjacent to said locking groove, said tear line operating to provide a tear strip formed from a section of said skirt means which extends below said tear line.

15. The reclosable container assembly of claim 14 wherein said support rib means bias said locking lip and closure member skirt means outwardly away from said container sidewall when said closure member is attached to said container to bias said tear off strip about said tear line and locking groove toward said container sidewall.

16. The reclosable container assembly of claim 15 wherein said tear-off strip includes a plurality of spaced apart grooves formed therein and extending into said tear-off strip to a thin membrane which extends across and bridges each such groove.

17. A reclosable container assembly comprising a container having a container sidewall extending to an open end, a laterally extending flange formed at said open end and extending outwardly from said container sidewall, a container locking lip extending from said laterally extending flange away from said open end in spaced relation to said sidewall, said locking lip including an outer seating surface which extends from said laterally extending flange and angles inwardly toward said container sidewall, and a plurality of spaced support rib means extending between said container sidewall and said locking lip, and a closure member having a skirt means thereon which engages the locking lip to attach the closure member to the container, said closure member including a top wall with said skirt means extending outwardly from the periphery of said top wall, the top wall and skirt means being formed such that the closure member does not contact the sidewall of said container when the closure member is attached to the container, said skirt means having an inner surface which engages the outer seating surface of said locking lip and which extends from said top wall and angles inwardly therefrom.

18. The reclosable container assembly of claim 17 wherein said skirt means includes locking groove means positioned below the angled inner surface thereof to secure said closure member to said locking lip and a tear strip extending below said locking groove means.

19. The reclosable container assembly of claim 18 wherein said locking lip decreases in thickness as it extends from said laterally extending flange and said closure member skirt means increases in thickness as it extends from said closure member top wall.

20. The reclosable container of claim 19 wherein said tear strip includes a plurality of spaced apart grooves formed therein and extending into said tear strip to a thin membrane which extends across and bridges each such groove.

* * * * *